US005186007A

United States Patent [19]

Takano et al.

[11] Patent Number: 5,186,007

[45] Date of Patent: Feb. 16, 1993

[54] CONTROLLED PROCESS FOR XENON CONCENTRATION

[75] Inventors: Hideaki Takano; Jitsuo Nakata; Toshiaki Oonishi, all of Wakayama, Japan

[73] Assignee: Kyodo Oxygen Co., Ltd., Japan

[21] Appl. No.: 770,887

[22] Filed: Oct. 4, 1991

[30] Foreign Application Priority Data

Oct. 13, 1990 [JP] Japan ..... 2-274197

[51] Int. Cl.[5] ..... F25J 3/04

[52] U.S. Cl. ..... 62/22; 55/66; 62/37; 423/262

[58] Field of Search ..... 62/22, 37; 55/66; 423/262

[56] References Cited

U.S. PATENT DOCUMENTS

| | | | |
|---|---|---|---|
| 3,222,879 | 12/1965 | Stoklosinski | 62/22 |
| 3,751,934 | 8/1973 | Frischbier | 62/22 |
| 4,568,528 | 2/1986 | Cheung | 62/22 |
| 4,574,006 | 3/1986 | Cheung | 62/22 |
| 4,647,299 | 3/1987 | Cheung | 62/22 |
| 5,039,500 | 8/1991 | Shino et al. | 423/262 |

FOREIGN PATENT DOCUMENTS

| | | |
|---|---|---|
| 47-22937 | 6/1972 | Japan . |
| 57-95583 | 6/1982 | Japan . |
| 62-297206 | 12/1987 | Japan . |
| 63-33634 | 7/1988 | Japan . |

OTHER PUBLICATIONS

*Fuji Techno-System Technical Report*, 1986, pp. 430–431.

*Primary Examiner*—Ronald C. Capossela
*Attorney, Agent, or Firm*—Wall and Roehrig

[57] ABSTRACT

The present invention relates to feeding liquid oxygen from the main condenser of the upper rectifying column of an air liquefying/separating unit into a xenon condensing column. The liquid oxygen is evaporated in varying amounts in correspondence to fluctuating amounts of liquid oxygen being fed into the xenon condensing column. The level and pressure of the liquid at the xenon condensing column is controlled and quantities of liquid oxygen is vented from the xenon condensing column at a constant level. The vented liquid oxygen is exchanged to high pressure oxygen gas in order to evaporate it, and this evaporated gaseous oxygen is supplied to a xenon absorptive column, and recovered as liquid oxygen through heat-exchangers.

5 Claims, 1 Drawing Sheet

CONTROLLED PROCESS FOR XENON CONCENTRATION

BACKGROUND OF THE INVENTION

This invention relates to a process for condensing trace amounts of xenon which are contained in liquid oxygen which has been vented from a main condenser of an air liquefying/separating unit, and for controlling the concentration of the xenon thus obtained at a given level. More particularly, the present invention relates to the condensation of xenon from liquid oxygen where the xenon concentration is controlled at a given level, even when the concentration of xenon in the liquid oxygen supplied from the main condenser of an air liquefying/separating unit fluctuates.

Xenon, a rare, gaseous element is used in numerous applications including in flash and fluorescent lamps, as a laser source, and in anesthetics. Xenon exists in ambient air at a level of 0.087 ppm. Highly purified xenon can be manufactured from liquified air via repeated separation processes.

Currently, xenon is recovered from liquid oxygen vented into the main condenser from the upper rectifying column in a large-scale air liquefying/separation unit. However the fraction of xenon found in the liquid oxygen vented from the main condenser is inversely proportional to the production amount of liquid oxygen.

Conventionally, xenon contained in liquid oxygen is recovered by a rectifying process. Recently a number of methods of so doing have been proposed. In one, reported in *Fuji TechnoSystem Technical Report* (61-2-1), 1986, pp. 430–431, rectification is used to condense xenon from liquid oxygen, using controlled concentrations of xenon with hydrocarbon groups removed through a catalytic combustion reaction in order to avoid the danger of explosion due to condensation of hydrocarbons (particularly methane) contained in the liquid oxygen.

In another proposed process, described in *Tokko-Sho,* 47–22937, oxygen and argon are exchanged in an argon exchanging column. This is followed by condensation of xenon via a rectifying process. Another process, described in *Tokkai-Sho,* 57-95583, involves condensation and rectification of xenon following exchange of high pressure nitrogen with oxygen. All these processes suffer from the common drawback of requiring multistage rectifying processes which, in turn, increases the costs of equipment and processing and therefore reduces the efficiency of xenon recovery.

The present inventors have filed a patent application, disclosed in *Tokkai-Sho,* 62-297206, in which xenon containing liquid oxygen, vented from the main condenser in the upper rectification column of an air separating unit, is subsequently fed into multiple adsorption columns filled with an adsorbent which selectively adsorbs the xenon. A series of adsorbing-desorbing steps gradually condenses the xenon, resulting, finally. in the recovery of highly purified xenon. This method overcomes many disadvantages and difficulties associated with conventional processes for xenon production.

However, due to the current trend of ever-growing demand for liquid oxygen, the production amounts of liquid oxygen is increasing. Many companies now set the lower limit guideline for liquid oxygen production at 1% of the total oxygen gas produced, and produce liquid oxygen at levels above 1%. Some companies increase the production amounts of liquid oxygen during the night shift, when the cost of electricity is lower. The increase in production amounts of liquid oxygen can result in problems when using the xenon production process described in *Tokkai-Sho,* 62-97206. These include (1) reduced xenon concentration in the increased production amounts of liquid oxygen (2) requirements for scaling up production equipment and (3) decreasing efficiency of xenon recovery due to variations in the amounts of liquid oxygen fed into the xenon recovery system.

Another process for xenon recovery, described in *Tokko-Sho,* 63,33634, involves condensation and rectification of xenon while exchanging it against oxygen gas containing lower hydrocarbons, following first stage xenon condensation and rectification. This process, like the one described in *Tokkai-Sho,* 62-297206, suffers from the current increase in production amounts of liquid oxygen by not being able to accommodate to wide fluctuations in the amounts of liquid oxygen fed into the condensing column.

SUMMARY OF THE INVENTION

It is therefore a primary object of the present invention to provide a controlled process for the concentration of xenon in which xenon contained in liquid oxygen can be condensed with a high recovery efficiency and a low operational cost.

It is a further object of the present invention to provide a controlled process for the concentration of xenon in which xenon contained in liquid oxygen can be condensed with a high recovery efficiency and a low operational cost, which process is independent of fluctuations in the production amount of liquid oxygen from the air liquefying/separating unit used to produce the liquid oxygen.

These and other objects of the present invention are attained by feeding liquid oxygen from the main condenser of the upper rectifying column of an air liquefying/separating unit into a xenon condensing column, varying evaporating amounts of liquid oxygen in correspondence to fluctuating amounts of liquid oxygen being fed into the xenon condensing column, controlling the level and pressure of the liquid at the xenon condensing column and venting quantities of liquid oxygen from the xenon condensing column at a constant level, heat-exchanging the vented liquid oxygen to high pressure oxygen gas in order to evaporate it, supplying this evaporated gaseous oxygen to the xenon adsorptive column, and recovering the high pressure oxygen as liquid oxygen through heat-exchangers.

Thus, in cases where large amounts of low xenon concentration liquid oxygen is to be fed into the xenon condensing column, xenon concentration in the raw gas fed thereafter to the xenon adsorptive column can nonetheless be kept constant by evaporating large amounts of liquid oxygen, thus keeping the vented amounts of liquid oxygen constant.

Furthermore, although the amount of liquid oxygen which is produced in the air liquefying/separating unit is reduced at the xenon condensing and xenon adsorptive columns, this reduction can be counteracted by liquefying high pressure oxygen through contact with heat-exchangers, thus maintaining liquid oxygen at sufficient levels to correspond to the necessary production amounts. This heat exchange is accomplished via heat-exchangers in the xenon condensing column, heatexchangers for the liquid oxygen vented from the xenon condensing column, and heat-exchangers for evaporated gas from both the xenon condensing column and the xenon adsorptive column.

BRIEF DESCRIPTION OF THE DRAWINGS

For a better understanding of these and other objects of the present invention, reference is made to the detailed description of the invention which is to be read in conjunction with the following drawing, wherein.

DETAILED DESCRIPTION OF THE INVENTION

In the practice of this invention, liquid oxygen containing trace amounts of xenon is fed from the main condenser of an air liquefying/separating unit into a xenon condensing column which contains installed heat-exchangers. The liquid level and pressure in the xenon condensing column and the amounts of liquid vented from the column are all maintained as controlled constants. This process prevents fluctuation of the xenon level contained in the evaporated oxygen due to fluctuations of the liquid level and pressure in the xenon condensing column.

Furthermore, xenon condensed liquid oxygen vented from the xenon condensing column is heat-exchanged with high pressure oxygen gas, and the high pressure oxygen gas is then collected as liquid oxygen, while the xenon condensed liquid oxygen is collected as xenon condensed oxygen gas. The xenon condensed oxygen gas is then fed into a column filled with adsorbent which selectively adsorbs the xenon. The amount of xenon condensed oxygen gas fed into this adsorptive column is kept constant, even when the production amounts of liquid oxygen in the air liquefying/separating unit varies. This allows the xenon contained in the liquid oxygen to be condensed with a high efficiency of recovery and a low cost of operation.

The liquid level and pressure in the xenon condensing column and the amount of liquid oxygen vented from the xenon condensing column are kept constant because (1) if the liquid level and pressure are allowed to vary over a relatively short time period, then the xenon level in the evaporated oxygen increases and (2) by keeping the vented amounts of liquid oxygen constant, xenon concentration in the raw gas supplied to the xenon adsorptive column in the succeeding process can be maintained at a desired level.

Figure 2:
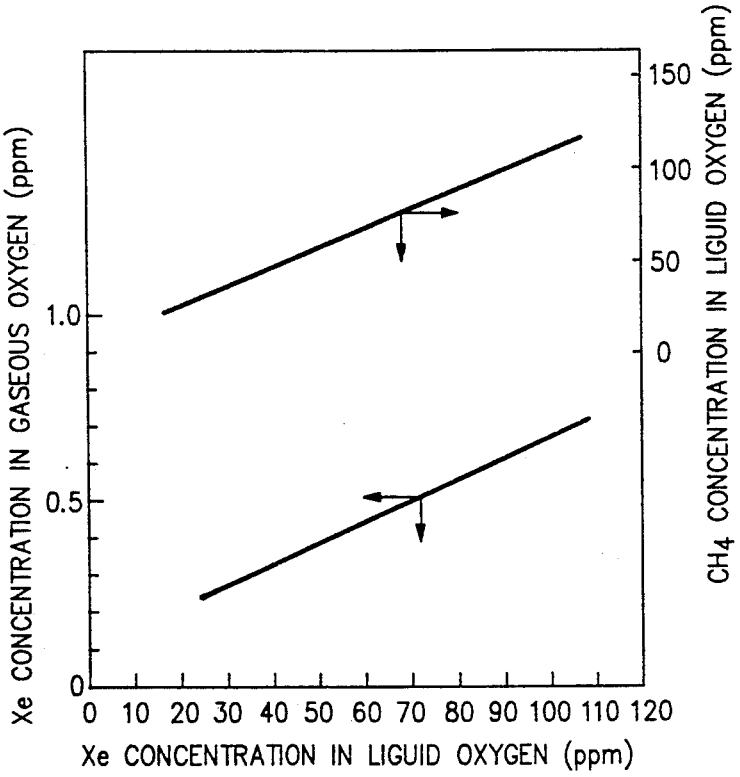
FIG. 2 represents a graph showing the behavior of xenon in liquid oxygen which is fed into a xenon condensation column.

FIG. 2 graphs the relationship of xenon concentration in the liquid oxygen fed from the main condenser to the xenon condensing column to the xenon concentration in gaseous oxygen. As can be seen from this figure, for a xenon concentration in liquid oxygen ranging from 30 to 100 ppm, the corresponding range of xenon in the evaporated oxygen gas is 0.28 to approximately 0.7 ppm. This indicates that a major portion of the xenon fed into the xenon condensing column is condensed and remains inside the liquid oxygen.

Furthermore, the amount of liquid oxygen which is produced by the air liquefying/separating unit may be reduced in the xenon condensing and xenon adsorptive column. This reduction may be counteracted by liquefying high pressure oxygen by contact with heat-exchangers in the xenon condensing column, heat-exchangers for liquid oxygen vented from the xenon condensing column, and heatexchangers for evaporated oxygen from both the xenon condensing and xenon adsorptive columns. Liquid oxygen obtained from these sources may be used to maintain the correct production level of liquid oxygen.

This invention can be better understood with reference to the following examples:

EXAMPLES

Example I

Figure 1:
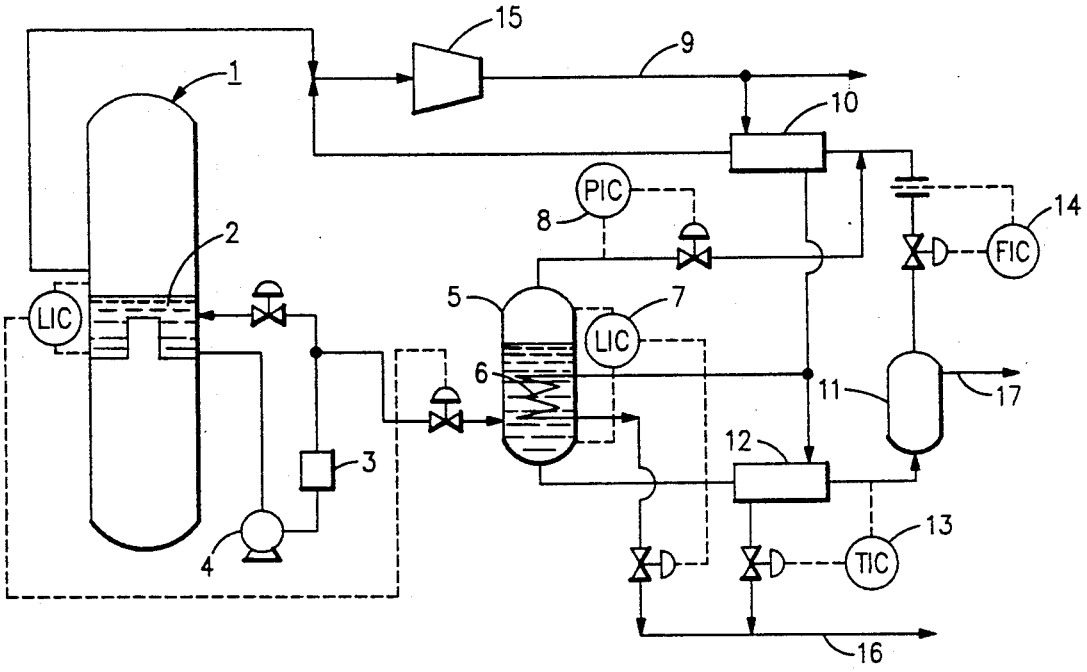
FIG. 1 represents a general flow chart of the condensation process according to this invention.

Referring now to FIG. 1, which shows a general flow chart of the condensing process according this invention, it can be seen that there is a rectifying column (1) in the air liquefying/separating unit. A portion of the liquid oxygen to be vented to the main condenser (2) in the upper chamber of this rectifying column (1) is cycled to the main condenser (2) through a hydrocarbon adsorptive column (3) by a pump (4) in order to remove the lower hydrocarbons. An appropriate amount of this liquid oxygen is introduced into a xenon condensing column (5). The liquid oxygen fed to the xenon condensing column (5) is then heat-exchanged with high pressure oxygen gas passing through heat-exchangers (6). At the same time, the xenon condensing column (5) controls the load fluctuation of the high pressure gas by a liquid level indicator/controller (7), thus keeping the liquid level constant. Also, at the same time, the xenon condensing column (5) controls the vented amounts of evaporated oxygen gas by means of a pressure indicator/controller (8), thus keeping the pressure constant.

High pressure oxygen gas is introduced as needed from high pressure oxygen gas supplying pipes (9). This high pressure oxygen gas is heat-exchanged with evaporated oxygen gas from the xenon condensing column (5) and oxygen gas from the xenon adsorptive column (11) through the heat-exchangers (10). A portion of the high pressure oxygen gas is recovered as liquid oxygen by heat-exchanging with the liquid oxygen through heat-exchangers (6), while the residue is heat-exchanged with liquid oxygen fed from the xenon condensing column (5) through heat-exchangers (12) and is recovered as liquid oxygen.

In addition, the liquid oxygen introduced from the xenon condensing column (5) is heat-exchanged with lower temperature high pressure oxygen gas at the heat-exchangers (12) and evaporated. The resulting lower temperature oxygen gas is controlled by a temperature indicator/controller (13) before being fed to the xenon adsorptive column (11). The flow rate of oxygen gas remaining after absorption of its xenon at the xenon adsorptive column (11) is regulated by a flow amount indicator/controller (14) in order to maintain it at a constant rate. Both the oxygen gas vented from the xenon adsorptive column (11) and the evaporated oxygen gas from the xenon condensing column (5) after being heat-exchanged with high pressure oxygen gas via the heat-exchangers (10), are cooled to ambient temperature and returned to the suction side of the oxygen compressor (15) so that they can be used as high pressure oxygen gas along with the oxygen gas that is recycled from the rectifying column (1). Meanwhile, the liquid oxygen collected by the xenon condensing column (5) and heat-exchangers (12) is vented through pipe lines (16) to be storèd as liquid oxygen in a tank (not shown).

The xenon which is adsorbed and condensed at the xenon adsorptive column (11) is desorbed, recycled, and passed through pipe lines (17) to a tank for holding condensed xenon (not shown).

Balancing the conversion of liquid oxygen vented from the main condenser in the rectifying column (1) to gaseous oxygen through the xenon condensing column (5) and heat-exchangers (12) is the liquefaction of high pressure gaseous oxygen by heat-exchange with the liquid oxygen at the xenon condensing column (5) and the heat-exchangers (12). This exchange process ensures that there sufficient amounts of liquid oxygen are always available. cExample II Liquid oxygen with a xenon concentration of approximately 3–11 ppm in oxygen production amounts, at approximately 200–700 $Nm^3/H$ (with an average of 360 $Nm^3/H$), is vented from the main condensing column (2) in an air liquefying/separating unit (1) with a capacity of 10,000 $Nm^3/H$. This vented liquid oxygen is then heat-exchanged with 15 $kg/cm^2G$ of oxygen gas compressed by the oxygen compressor (15) to evaporate a liquid oxygen of approximately 130–630 $Nm^3/H$, and eventually returned to the suction side of the oxygen compressor (15) after having been cooled through heat-exchangers (10).

Liquid oxygen containing 40 ppm of condensed xenon, which has been obtained from the xenon condensing column, (5) is vented at 70 $Nm^3/H$, heat-exchanged to evaporate with high pressure oxygen gas at the heat-exchangers (12), controlled at an appropriate temperature, and fed to a xenon adsorptive column. This results in recovery of xenon with an initial purity of 1.5% at a 97% recovery efficiency.

Additionally, the high pressure oxygen gas which was utilized in heat-exchange with the liquid oxygen, is liquified at the xenon condensing column (5) and the heat-exchangers (12) and liquid oxygen of approximately 110–600 $Nm^3/H$ is recovered.

Consequently, even when the amount of liquid oxygen vented from the main condenser (2) of the liquefying column (1) fluctuates widely, the system which has been described will provide a predetermined amount of liquid oxygen containing a fixed xenon concentration, thus allowing the production of xenon with a high recovery efficiency. In comparison with conventional methods, the capacity of the xenon adsorptive column (11) can be substantially reduced; for example, the column diameter can be reduced by as much as one third ($\frac{2}{3}$).

While this invention has been explained with reference to the structure disclosed herein, it is not confined to the details set forth and this application is intended to cover any modifications and changes as may come within the scope of the following claims:

What is claimed is:

1. A process for the concentration of xenon from trace amounts contained in liquid oxygen comprising the steps of:

feeding said liquid oxygen to a xenon condensing column which contains heat-exchangers;

controlling the amount of liquid oxygen evaporated to correspond to the amount of the liquid oxygen fed into said xenon condensing column;

controlling liquid and pressure levels of said xenon condensing column while keeping constant the amount of liquid oxygen vented from said xenon condensing column;

heat-exchanging xenon condensed liquid oxygen vented from said xenon condensing column with high pressure oxygen gas;

recovering said heat-exchanged high pressure oxygen gas as liquid oxygen;

introducing xenon condensed oxygen gas converted from said xenon condensed liquid oxygen in the heat-exchanging step to a xenon adsorptive column; and selectively adsorbing and condensing xenon from said xenon adsorptive column.

2. A process for the concentration of xenon from trace amounts contained in liquid oxygen as in claim 2, using production amounts of oxygen containing 3–11 ppm xenon at approximately 200–700 $Nm^{3/H}$.

3. A process for the concentration of xenon from trace amounts contained in liquid oxygen as in claim 2, where the oxygen gas used for heat-exchange with said liquid oxygen fed into the xenon condenser has been compressed to 15 $kg/cm^2G$.

4. A process for the concentration of xenon from trace amounts contained in liquid oxygen as in claim 2, where the liquid oxygen recovered from heat exchange in the xenon condensing column is approximately 110–600 $Nm^3/H$.

5. A process for the concentration of xenon from trace amount contained in liquid oxygen comprising the steps of:

feeding the liquid oxygen to a xenon condensing column which contains a plurality of heat-exchangers;

evaporating liquid oxygen at a controlled rate so as to correspond to the amount of liquid oxygen fed into said xenon condensing column;

exchanging heat energy between xenon condensed liquid oxygen vented from said xenon condensing column and high pressure oxygen gas;

introducing said xenon condensed oxygen gas converted from said xenon condensed liquid oxygen in the heat-exchanging step to a xenon adsorptive column; and selectively adsorbing and condensing xenon from said xenon adsorptive column.

* * * * *